US007168915B2

(12) United States Patent
Doering et al.

(10) Patent No.: US 7,168,915 B2
(45) Date of Patent: Jan. 30, 2007

(54) APPARATUS FOR AXIAL ADJUSTMENT OF CHOPPER PUMP CLEARANCES

(75) Inventors: Brandon R. Doering, West Jordan, UT (US); James C. Harmon, Salt Lake City, UT (US)

(73) Assignee: Envirotech Pumpsystems, Inc., Salt Lake City, UT (US)

( * ) Notice: Subject to any disclaimer, the term of this patent is extended or adjusted under 35 U.S.C. 154(b) by 95 days.

(21) Appl. No.: 10/894,731

(22) Filed: Jul. 20, 2004
(Under 37 CFR 1.47)

(65) Prior Publication Data

US 2005/0047908 A1 Mar. 3, 2005

Related U.S. Application Data

(60) Provisional application No. 60/489,053, filed on Jul. 22, 2003.

(51) Int. Cl.
*F04D 29/042* (2006.01)

(52) U.S. Cl. ..... 415/121.1; 415/131; 415/132

(58) Field of Classification Search ..... 416/133; 415/131, 132, 121, 121.1
See application file for complete search history.

(56) References Cited

U.S. PATENT DOCUMENTS 3,155,046 A 11/1964 Vaughan
3,774,323 A 11/1973 Vaughn
3,973,866 A 8/1976 Vaughan
4,439,096 A * 3/1984 Rockwood et al. ..... 415/131
4,527,947 A 7/1985 Elliott
4,840,384 A 6/1989 Dorsch
4,842,479 A 6/1989 Dorsch
5,076,757 A 12/1991 Dorsch
5,152,663 A * 10/1992 Peroaho et al. ..... 415/131
5,256,032 A * 10/1993 Dorsch ..... 415/121.1
5,456,580 A 10/1995 Dorsch
5,460,482 A 10/1995 Dorsch
5,460,483 A 10/1995 Dorsch
5,951,244 A * 9/1999 Knight, Sr. ..... 415/132
6,190,121 B1 2/2001 Hayward et al.
6,224,331 B1 5/2001 Hayward et al.

* cited by examiner

*Primary Examiner*—Richard A. Edgar
(74) *Attorney, Agent, or Firm*—Morriss O'Bryant Compagni

(57) ABSTRACT

Axial adjustment apparatus is provided in a centrifugal pump to effect adjustment of the impeller relative to adjacent pump elements. Specifically preferred is adjustment apparatus in a chopper pump that provides adjustment of the impeller relative to a chopper plate to facilitate continuous efficient cutting of solids by the pump. The adjustment apparatus may also include adjustment structure for providing axial adjustment between the impeller and a plate-like member positioned adjacent the drive side of the impeller to effect adjustment of cutting tolerances in cutting elements positioned between the impeller and plate-like member. The invention further includes a seal mechanism configured and positioned to retain the seal height of the seals throughout continuous adjustment of the impeller.

15 Claims, 6 Drawing Sheets

APPARATUS FOR AXIAL ADJUSTMENT OF CHOPPER PUMP CLEARANCES

CROSS-REFERENCE TO RELATED APPLICATION

This application is a non-provisional application claiming priority to provisional patent application Ser. No. 60/489,053 filed Jul. 22, 2003.

BACKGROUND OF THE INVENTION

1. Field of the Invention

This invention relates to centrifugal pumps of the type known as chopper pumps, and specifically relates to an improved means of axially adjusting the clearances between the pump elements as the elements wear.

2. Description of Related Art

Centrifugal pumps of the type known as chopper pumps are typically employed in processing fluids that contain solid waste materials, such as metal, plastics, municipal waste, animal byproducts, etc. Chopper pumps are structured with cutting elements that operate to chop or cut entrained solids in the fluid into a size that can be disposed of or processed further as needed.

Chopper pumps are typically characterized as having an impeller that is structured with vanes having cutting edges. The cutting edges of the vanes contact a cutting element positioned adjacent the vanes of the impeller to exert a cutting or chopping action on the solid material as it enters the pump. A very close cutting clearance is maintained between the vanes of the impeller and the cutting element to assure proper cutting action on the solids. However, with extended use of the pump, the solids begin to wear down the cutting element and/or the vanes of the impeller such that a gap begins to form between the cutting element and vanes of the impeller. It is critical to the efficiency of the pump to assure that the clearance between the structures is maintained at an appropriate distance or tolerance to optimize cutting action on the solids.

Some chopper pumps are also structured with impellers that have expeller or pump out vanes positioned on the back or drive side of the impeller to assure that solid or stringy material does not get caught between the back side of the impeller and the pump casing, or back plate that may be positioned between the pump casing and the impeller. Additional cutting elements may also be provided on the back side of the impeller to help cut the solids into smaller sizes so that they can be expelled from behind the impeller and not interfere with rotation of the drive shaft. Again, with extended operation of the pump, solids that may infiltrate behind the impeller eventually wear down the cutting elements and/or the expeller vanes, and the clearance between the cutting elements increases with wear. The clearance must then be adjusted to close the gap in order to maintain optimum cutting efficiency behind the impeller.

Conventionally known chopper pumps provide various means for adjusting the pump elements to provide closer cutting clearances. For example, some chopper pumps are adjusted by the insertion of selected sizes of shims between parts of the pump, thereby moving one element closer to another. In other known pumps, adjustment screws are employed. The known adjustment means employed in conventional chopper pumps, however, require the volute casing of the pump to be moved in relationship to the drive casing or bearing frame, or that the volute casing be moved relative to the suction casing, or both the suction casing and drive casing.

Conventionally known adjustment means result in a required change in the mounting dimensions of the pump feet or modification of the piping connection dimensions of the pump, or both. Consequently, the pump must be loosened from its base and some re-alignment performed, either in the drive or piping connections. In lieu of making such re-alignments, the connections must absorb the resulting movement within tolerated levels. Most importantly, such adjustments require that the pump be shut down to effect the required modifications, which translates into increased operation costs.

In addition to the above-noted difficulties that are inherent with conventional adjustment means or devices, movement of the impeller and drive shaft in conventional pumps is ultimately limited because of the sealing mechanisms of the drive shaft. That is, known pump designs have fixed seals about, or associated in some manner with, the drive shaft. Consequently, as the drive shaft is axially adjusted by known methods, the seal working height is also adjusted to the ultimate detriment of the seal and the life of the sealing mechanism is compromised.

Thus, it would be advantageous in the art to provide a centrifugal chopper pump having adjustment means for modifying the cutting clearances between the pump elements such that the adjustment can be effected without having to modify the pump connections or dimensions, without compromising the sealing mechanism and without having to shut down the operation of the pump.

BRIEF SUMMARY OF THE INVENTION

In accordance with the present invention, adjusting apparatus is provided for adjusting the cutting clearances between cutting elements of a centrifugal pump, particularly of the chopper type, in a manner which allows the clearance adjustments to be made without having to modify any of the connections or dimensions of the pump, which preserves the mechanical seals of the drive mechanism and which allows the adjustments to be made while the pump is in operation.

The adjusting apparatus of the present invention generally provides first adjusting structure for axially adjusting the impeller relative to a chopping element positioned at the suction end of the pump, and second adjusting structure for axially adjusting cutting elements located at the drive side of the pump to bring the cutting elements into closer clearance with the drive side of the impeller.

The first adjusting structure is configured and positioned to effect an axial movement of the drive shaft to consequently effect an axial movement of the impeller. The first adjusting structure is constructed in a manner that allows the drive shaft to be axially adjusted relative to the drive casing or bearing frame through which the drive shaft extends without having to disassemble the pump or readjust the bearings or seals associated with the drive shaft. In one exemplary embodiment described herein, the drive shaft is axially adjustable relative to the bearing frame through which it extends by providing a bearing cap that is secured to the drive shaft and is axially adjustable relative to the bearing frame.

The second adjusting structure is configured and positioned to effect axial movement of cutting elements located at the drive side of the pump to bring the cutting elements into closer tolerances with the drive side of the impeller. The cutting elements at the drive side of the pump may be provided on an axially movable plate element that is associated with the pump casing of the pump and which is positioned adjacent to the drive side of the impeller.

A particularly suitable embodiment of the invention includes a back plate that is positioned between the bearing frame and drive side of the impeller and is provided with cutting elements that interact with the impeller to provide a cutting of solids on the drive side of the impeller. The back plate is also preferably structured to house a sealing mechanism that is movable with the drive shaft so that the sealing height is maintained. A housing for the movable sealing mechanism may, however, be separately provided from the back plate itself, but may preferably be adjustable with the back plate in accordance with the present invention.

It is particularly suitable that, in the present invention, bearings and seals that are associated with the drive shaft are movable concurrently with the axial movement of the drive shaft and back plate to permit adjustment of the drive shaft and cutting elements during operation of the pump. The ability of the seals and bearings to move axially with the drive shaft presents a particular advantage over known chopper pump designs by eliminating the need to effect further adjustments of the bearings, seals or casing segments of the pump casing.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

The adjusting apparatus of the present invention is structured to provide axial adjustment of the impeller cutting clearances, on both the suctions side and drive side of the impeller, and may be structured and configured in a number of different ways. FIGS. 1–6 present merely one example of a centrifugal pump arrangement and merely one exemplar means of providing adjusting apparatus in the centrifugal pump shown.

Figure 1:
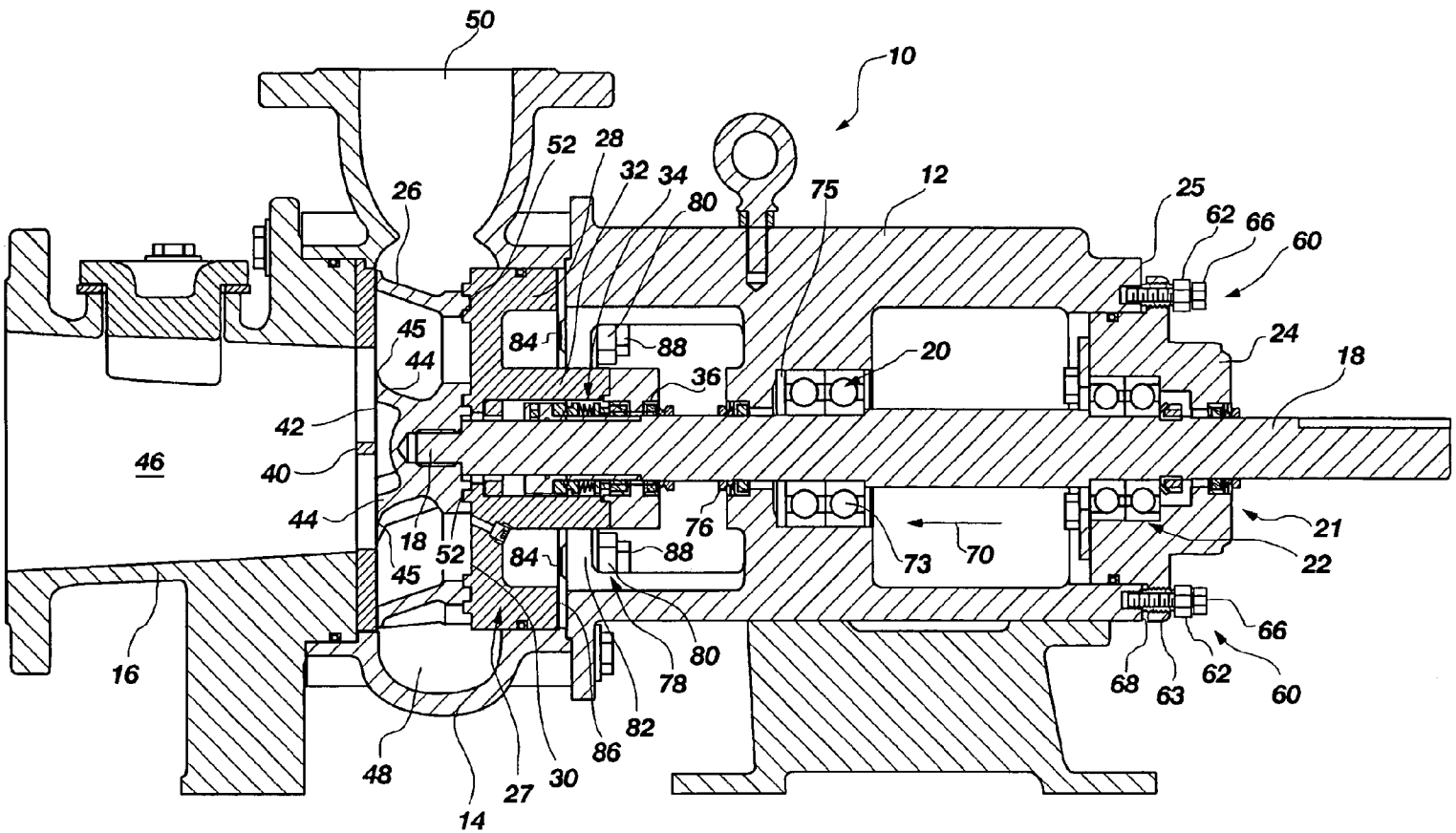
FIG. 1 is a view in longitudinal cross section of a centrifugal pump of the chopper type employing the adjustment structures of the present invention.

FIG. 1 illustrates in longitudinal cross section a centrifugal chopper pump 10 employing the apparatus of the present invention. The centrifugal chopper pump 10 generally comprises a pump casing, shown here as further comprising a drive casing, or bearing frame 12, a volute casing 14 and a suction casing 16. The volute casing 14 is secured to the bearing frame 12 and the suction casing 16 is secured to the volute casing 14.

A drive shaft 18 extends through the bearing frame 12 and is supported by a first bearing assembly 20 and at least one other drive shaft support 21, which is illustrated here by way of example as a second bearing assembly 22. The second bearing assembly 22 may be housed within a bearing cap 24 that, as shown, is adjustably secured to the end face 25 of the bearing frame 12. Alternatively, the second bearing assembly 22 may be positioned within the bearing frame 12. Further alternatively, the drive shaft support 21 may be a structural element separate from the second bearing assembly and may serve only as a support by which the drive shaft 18 is axially adjustable, as described further hereafter.

The drive shaft 18 further extends through the volute casing 14 to engage the impeller 26, which is positioned within the volute casing 14. The drive shaft 18 may also extend through a separate plate-like member 27 which may have cutting elements, as described further hereinafter. The separate plate-like member 27 shown in FIG. 1 is a back plate 28 which is received within the volute casing 14 and is positioned between the drive side 30 of the impeller 26 and the bearing frame 12. The back plate 28, in this particular embodiment, is formed with an annular collar 32 which extends into the bearing frame 12 and serves to house a sealing mechanism 34. An annular stuffing box 36 surrounds the drive shaft 18 and seats against the annular collar 32 of the back plate 28 to complete the sealing assembly. The back plate 28 may be of any other suitable design, configuration or arrangement.

The chopper pump 10 is further structured with an intake or chopper plate 40 which is positioned between the suction casing 16 and the volute casing 14. The chopper plate 40 is structured with cutting members 42 which are oriented in the direction of the impeller 26. The impeller 26 has at least one vane 44 which has a cutting edge 45. Typically, a plurality of vanes 44 are provided as shown. The impeller 26 is positioned in very close tolerance to the chopper plate 40 to rotate in very close proximity to the cutting members 42 of the chopper plate 40. As the solid material enters the pump 10 through the inlet 46, the material entering through the chopper plate 40 is cut by the interaction of the cutting members 42 of the chopper plate 40 and the cutting edges 45 of the vanes 44. The fluid and chopped solids are then directed by the impeller 26 to the volute 48 of the pump 10 and then out of the pump through the outlet 50.

The pump 10 may also be structured with cutting elements 52 located in the region of the drive side 30 of the impeller 26 to further process solids that may infiltrate between the back side 30 of the impeller 26 and the back plate 28. The cutting elements 52 may be located on the drive side 30 of the impeller 26, on the back plate 28, or both. The cutting elements 52 are structured and positioned to provide cutting action on the solids before the solids can reach the drive shaft 18 and interfere with the rotation of the drive shaft 18 or operation of the associated sealing mechanism 34.

The interaction between the cutting members 42 and the vanes 44 of the impeller 26 to chop or cut solid materials in the influent eventually causes a wearing down of those elements such that a widening gap begins to form between the cutting edge 45 of the vanes 44 and the cutting members 42 of the chopper plate. When the clearance between those parts increases, the vanes 44 and cutting members 42 become inefficient or ineffective at cutting the solids.

Likewise, with extended pump operation, the cutting elements 52 on or near the drive side 30 of the impeller 26 become worn and a widening gap begins to form between the cutting elements of the impeller 26 and/or the back plate 28. Again, cutting efficiency is reduced and pump operation is compromised. It then becomes necessary to reduce the widened clearances between cutting parts to bring them into close proximity again to assure efficient cutting.

The present invention provides an improved means of adjusting the cutting parts of the pump to reduce the widened clearances caused by wear. A first adjusting apparatus 60 is provided to adjust the impeller 26 relative to the chopper plate 40, thereby adjusting the clearance between the cutting edge 45 of the vanes 44 of the impeller 26 and the cutting members 42 of the chopper plate 40. In the exemplar embodiment shown in FIGS. 1 and 3, the first adjusting apparatus 60 may comprise at least one adjusting screw 62 which extends through a flange 63 of the bearing cap 24 and contacts the end face 25 of the bearing frame 12.

Figure 2:
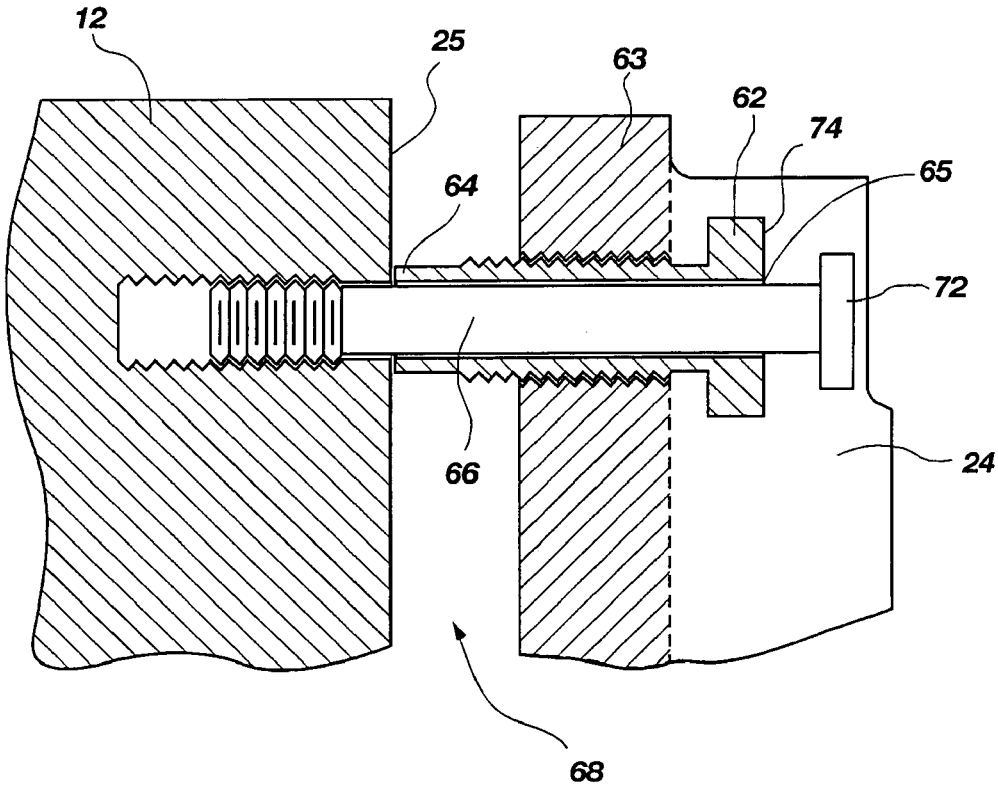
FIG. 2 is an enlarged view of the first adjusting apparatus of the present invention.

As shown in larger scale in FIG. 2, the adjusting screw 62 is threaded through the flange 63 of the bearing cap 24 and the inward end 64 of the adjusting screw 62 contacts the end face 25 of the bearing frame 12. The adjusting screw 62 is formed with a hollow center 65 to receive an attachment screw 66 therethrough. The attachment screw 66 extends through the center 65 of the adjusting screw 62 and is threadingly secured into the end face 25 of the bearing frame 12. When the bearing cap 24 is secured to the bearing frame 12 at initial operation of the pump 10, the bearing cap 24 is positioned relative to the bearing frame 12 so that a gap 68 exists between the bearing cap 24 and the bearing frame 12.

Figure 3:
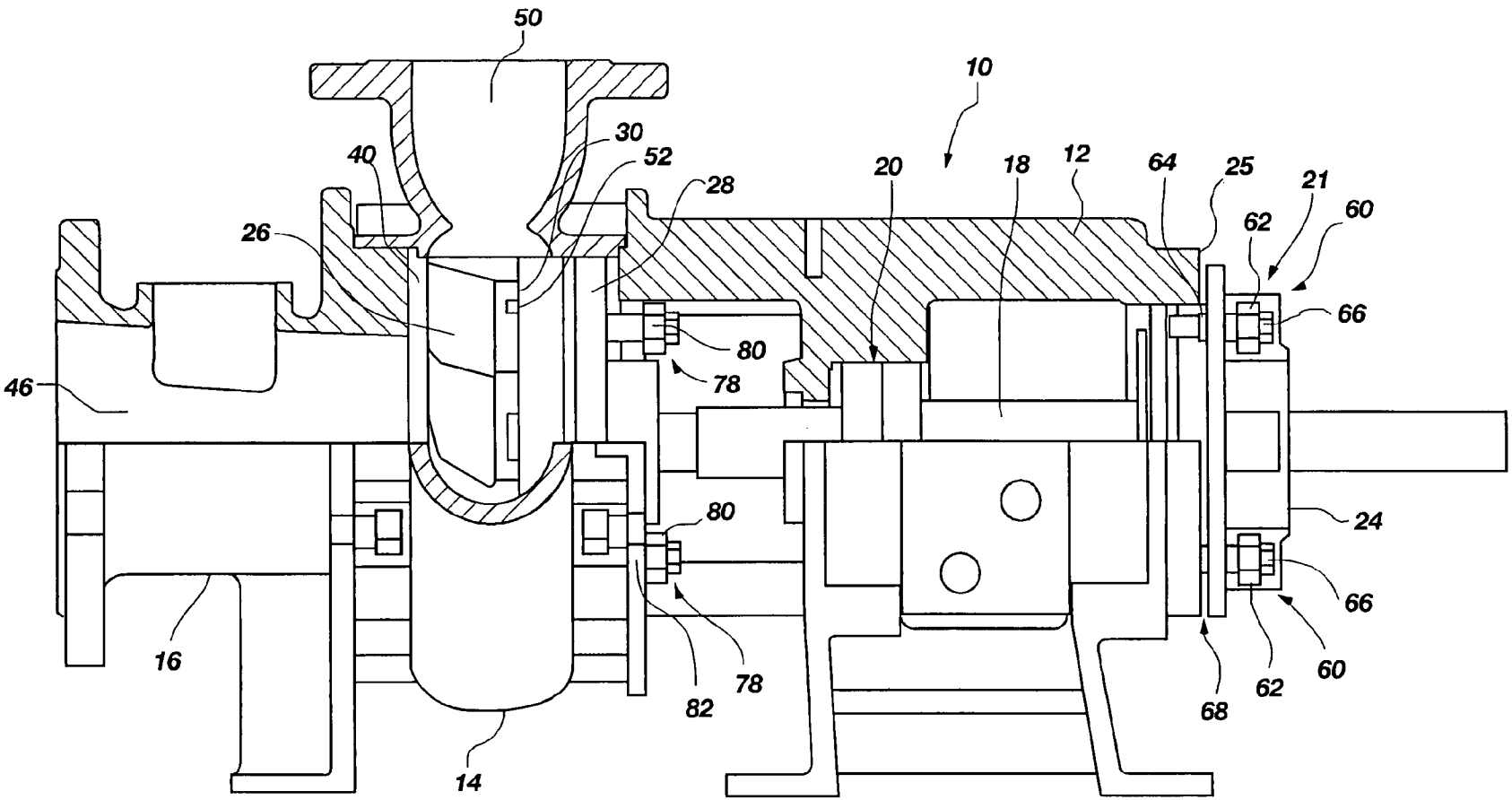
FIG. 3 is an elevational view in partial cutaway of a chopper pump illustrating the positioning of the adjusting apparatus of the present invention.

As the cutting edge 45 of the vanes 44 of the impeller 26 and the cutting members 42 of the chopper plate 40 become worn, and the clearance between those cutting elements widens, the impeller 26 may then be axially adjusted in a direction indicated by arrow 70 (FIG. 1) toward the chopper plate 40 to reduce the widened clearance. This is accomplished by slightly loosening the attachment screws 66, as shown in FIG. 2, and then rotating the adjusting screws 62 to bring the bearing cap 24 into closer proximity to the bearing frame 12, thereby reducing the dimension of the gap 68 therebetween. The attachment screws 66 are then rotated again to secure the head 72 of each attachment screw 66 against the head 74 of the respective adjusting screw 62 through which it extends, thereby securing the adjusting screw 62 in place, as shown in FIGS. 3 and 4.

Figure 4:
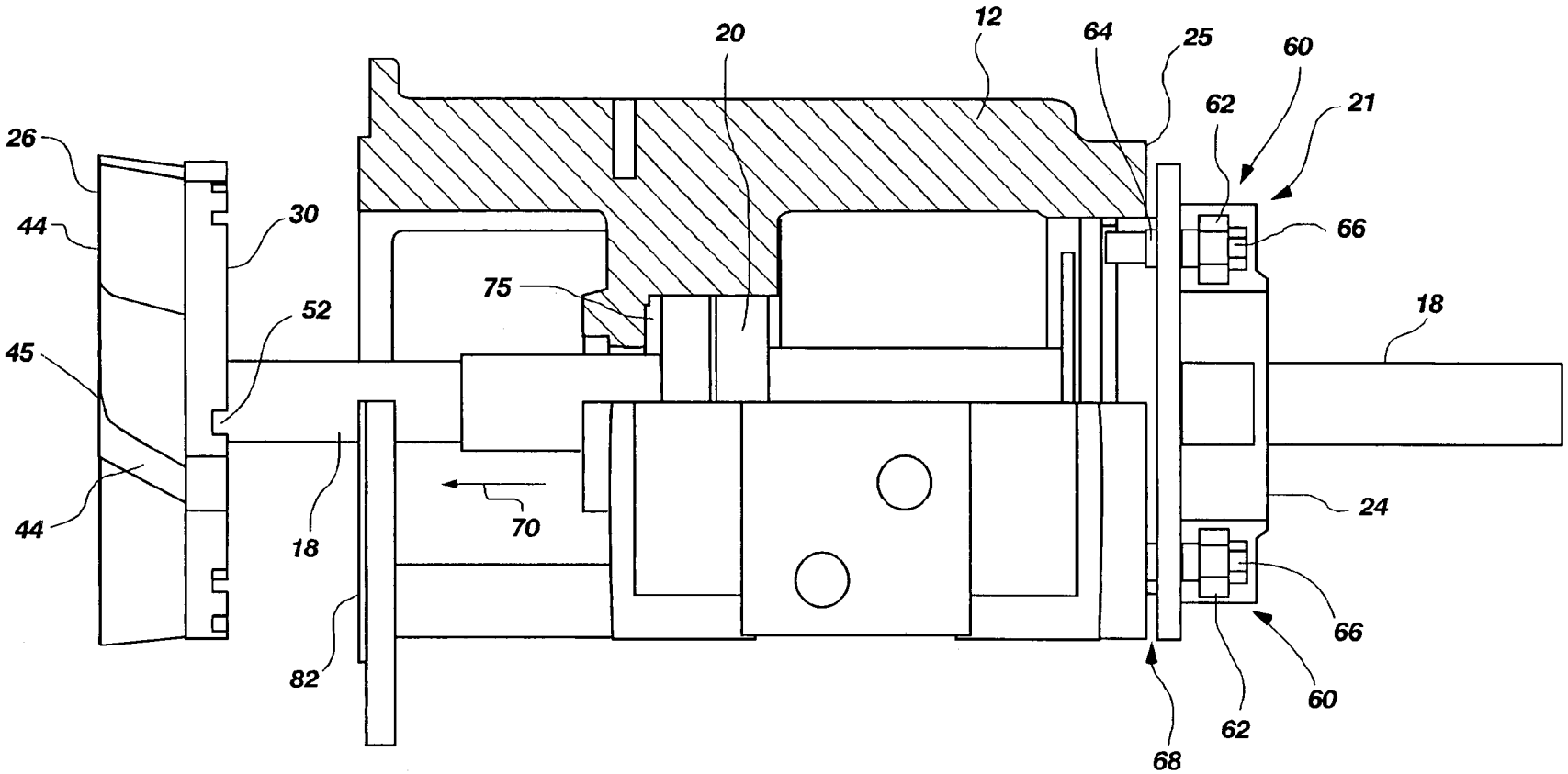
FIG. 4 is an elevational view in partial cutaway of the pump housing, drive shaft and impeller of a pump illustrating the positioning of the first adjusting apparatus.

As may be best appreciated by reference to FIG. 4, movement of the bearing cap 24 by virtue of the adjusting screws 62 causes the drive shaft 18 to move in the direction of arrow 70. The drive shaft 18 remains in place relative to the second bearing assembly 22 since the bearing cap 24 moves with the drive shaft 18. Referring again to FIG. 1, bearings 73 of the first bearing assembly 20 are connection to the drive shaft 18 and move axially with the drive shaft 18 when adjusted. A space 75 is provided in the bearing frame 12 to permit axial movement of the bearings 73 in the direction of arrow 70. A ring seal 76 is positioned in the bearing frame 12 to retain a comprehensive seal of the first bearing assembly, and is of a type that allows movement of the drive shaft 18 relative thereto while preserving the seal.

It should be noted that while the invention has been described thus far with the bearing cap 24 acting as a drive shaft support 21, it is equally possible to provide a drive shaft support 21 that is not also a housing for a bearing assembly, but which is nonetheless positioned relative to the bearing frame 12 so that the first adjustment apparatus is positioned between the drive shaft support 21 and the bearing frame 12 to effect movement of the drive shaft 18 via the drive shaft support 21 in a manner as previously described.

Figure 5:
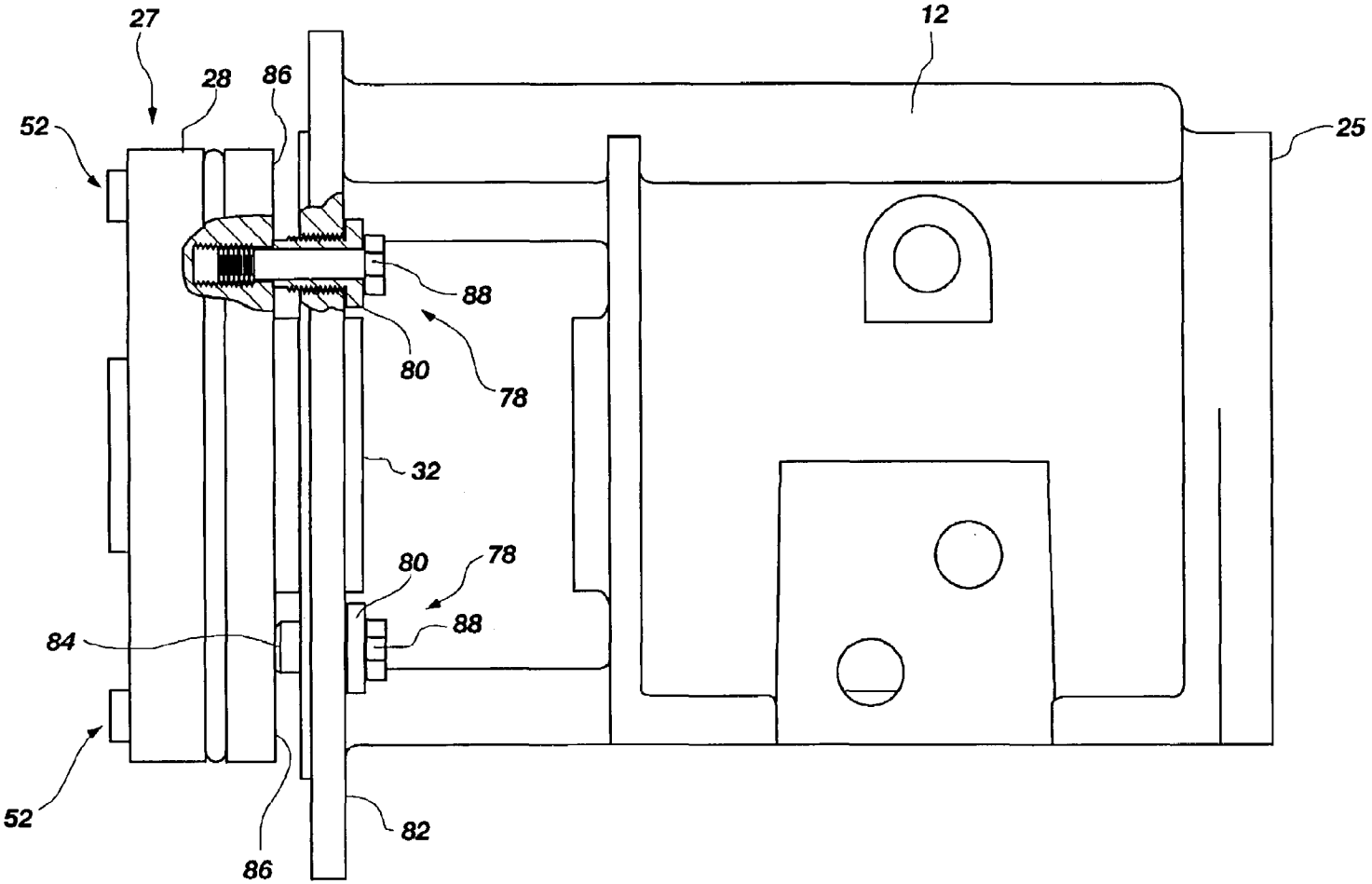
FIG. 5 is an elevational view in partial cutaway of the back plate and pump housing illustrating the positioning of the second adjusting apparatus.

Movement of the drive shaft 18 in the direction of arrow 70 causes the impeller 26 to move into closer proximity to the chopper plate 40. Adjustment of the impeller 26 relative to the chopper plate 40 consequently results in an adjustment of the impeller 26 away from the back plate 28 in the direction of arrow 70, thereby causing an increased gap or clearance between the cutting elements 52 of the impeller 26 and/or the back plate 28. Hence, axial adjustment between the back plate 28 and the impeller 26 must be effected at the same time as the axial adjustment between the impeller 26 and the chopper plate 60 to bring the back plate 28 into proximity again with the impeller 26 so that the cutting elements 52 associated therewith will operate efficiently to cut the solid material. The present invention, therefore, provides second adjustment apparatus 78 for axially adjusting the back plate 28, as illustrated in FIGS. 1, 3 and 5.

The second adjustment apparatus 78 further may be structured in a manner similar to the first adjustment apparatus 60 as previously described. Accordingly, at least one adjustment screw 80, and preferably a plurality of adjustment screws 80, is threadingly received through the front face 82 of the bearing frame 12. Each adjustment screw 80 has an inward end 84 which registers against the drive side 86 of the back plate 28. The adjustment screw 80 is formed with a hollow center shaft through which an attachment screw 88 is slidingly positioned. The attachment screw 88 is threadingly secured into the drive side 86 of the back plate 28.

To adjust the back plate 28 after the impeller 26 has been axially adjusted, the attachment screw 88 is loosened by unscrewing it from the back plate 28. The adjustment screw 80 is then rotated to move the back plate 28 in the direction of arrow 70 toward the impeller 26, thereby reducing the clearance between the back plate 28 and the impeller 26. When the back plate 28 has been axially moved by the required amount to provide a close tolerance between the cutting elements 52, the attachment screw 88 is then secured against the adjustment screw 80 to secure the back plate 28 in place.

Figure 6:
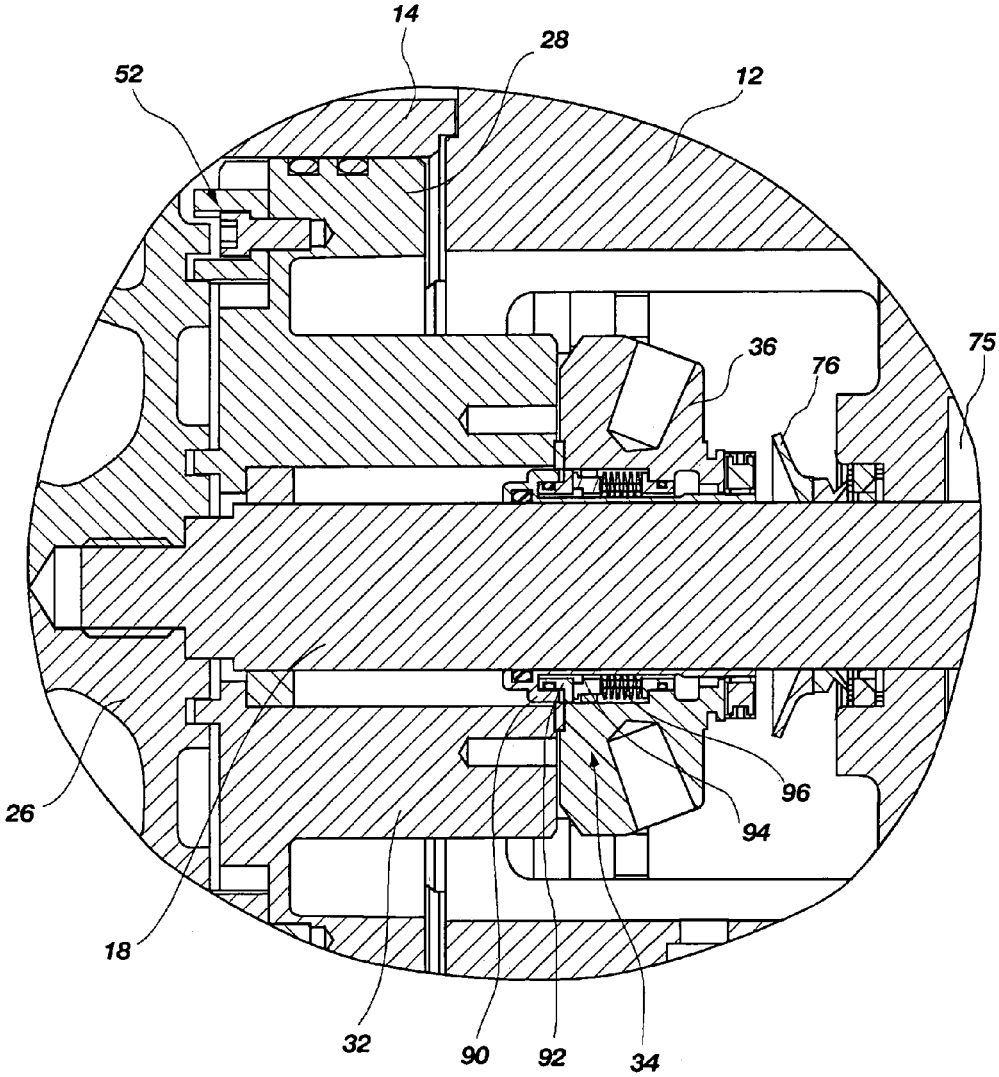
FIG. 6 is an enlarged view in cross section of the drive shaft sealing mechanism of the invention.

FIG. 6 illustrates in further detail an exemplary sealing mechanism 34 of the present invention which facilitates axial adjustment of the impeller 26. The sealing mechanism 34 may comprise a rotating seal housing 90 which houses a rotating seal member 92. The sealing mechanism 34 further comprises a stationary seal member 94 and a spring element 96 which is biased against the stationary seal member 94. As the drive shaft 18 and impeller are axially adjusted in the direction of arrow 70, the rotating seal housing and rotating seal member 92 move with the drive shaft 18 and the spring element 96 expands to retain a sealing engagement between the rotating seal member 92 and the stationary seal member 94.

As the back plate 28 is axially moved in the direction of arrow 70 following adjustment of the drive shaft 18, the stuffing box 36 moves with the back plate 28, to which it is secured. The stationary seal member 94 is also caused to move with the annular stuffing box 36. The spring element 96 is compressed again with movement of the annular stuffing box 36 to retain the seal face between the rotating seal member 92 and the stationary seal member 94. Thus, it can be appreciated that the exemplary sealing mechanism 34 construction enables the appropriate amount of axial adjustment to be achieved between the impeller 26 and the chopper plate 40, and between the back plate 28 and the impeller 26, while retaining the seal height of the sealing mechanism 34. Additionally, the exemplary structure enables the axial adjustment of the impeller 26 and back plate 28 to be effected without having to disassemble the pump or readjust or recalibrate any of the connections of the pump.

Adjustment of the cutting clearances as provided by the present invention can be effected with precision. For example, it may be desirable that the cutting clearances on both the suction side and drive side of the impeller 26, as previously described, are set at 0.010 inch. Therefore, the adjustment screws 62, 80 may be structured with a visible indicia that represents a defined measurement of axial movement so that movement of the adjustment screws 62, 80 achieve the desired amount of axial adjustment. For example, the adjustment screws 62, 80 are illustrated as having hex heads, and the hex heads of the screws may be manufactured so that each flat surface of the head represents a revolution of the screw sufficient to achieve a 0.010 inch adjustment.

Thus, when axial adjustment of the cutting clearances is required, the attachment screws 66 and 88, respectively, are loosened. The adjustment screw 62 is turned in the manner previously described until the impeller 26 contacts the chopper plate 40. The position of the hex head of the adjustment screw 62 is noted and then rotated back by one flat of the head, which adjusts the impeller 26 away from the chopper plate 40 by 0.010 inch. The attachment screw 66 is then secured as previously described. Similarly, the adjustment screw 80 of the second adjustment apparatus 78 is turned until the back plate 28 contacts the impeller 26. The position of the hex head of the adjustment screw 80 is noted and then turned by one flat of the head to adjust the back plate 28 away from the impeller 26 by 0.010 inch. The attachment screw 88 is then tightened to secure the back plate 28 in position. Again, the described adjustment amount of 0.010 inch is by way of example only and other adjustment measurements, as well as adjustment calibration means, may be employed with the invention.

While it may be preferred to effect adjustment of the impeller and the back plate in the manner described while the pump is not in active operation or use (i.e., not pumping fluid), the present invention allows the necessary adjustments to be made while the pump is in operation. Consequently, the present invention provides an improved means of adjusting the cutting parts of the pump as compared with known adjustment means.

The adjustment apparatus of the present invention is described herein with respect to a centrifugal pump of the chopper type and is particularly suited for such pumps. However, the adjustment apparatus of the present invention may be adapted for use in other types or configurations of centrifugal pumps where axial adjustment of the impeller relative to suction side and drive side elements of the pump casing are required. Thus, reference herein to particular details of the pump and the structure of the adjustment, apparatus of the invention are by way of example, and not by way of limitation.

What is claimed is:

1. A centrifugal pump structured to provide axial adjustment of elements of the pump, comprising:

a pump casing for housing a bearing assembly and for receiving at least a portion of a drive shaft through said bearing assembly, said pump casing having a front face and an end face;

an impeller attached to said drive shaft and positioned outside said pump casing in proximity to said front face;

a plate-like member positioned between said front face of said pump casing and said impeller;

first adjustment apparatus positioned between said end face of said pump casing and said drive shaft to effect axial adjustment of said drive shaft and said impeller to distance said impeller from said front face of said pump casing; and second adjustment apparatus positioned between said front face of said pump casing and said plate-like member to effect axial adjustment of said plate-like member away from said front face of said pump casing and toward said impeller.

2. The centrifugal pump of claim 1 wherein said pump casing further comprises a bearing frame having said end face and said front face and a drive shaft support, and wherein said drive shaft extends through said drive shaft support, and said first adjustment apparatus is positioned between said drive shaft support and said end face.

3. The centrifugal pump of claim 2 wherein said drive shaft support is a bearing cap structured for housing a bearing assembly.

4. The centrifugal pump of claim 2 wherein said second adjustment apparatus is positioned between said front face of said bearing frame and said plate-like member.

5. The centrifugal pump of claim 4 wherein said plate-like member is a back plate.

6. The centrifugal pump of claim 5 wherein said back plate is structured with cutting elements that interact with said impeller to effect cutting of solids.

7. The centrifugal pump of claim 6 wherein said impeller further comprises a drive side and is structured with cutting elements on said drive side which interact with said cutting elements on said back plate.

8. The centrifugal pump of claim 2 wherein said first adjustment apparatus further comprises at least one adjusting screw positioned between said drive shaft support and said bearing frame which provides selective axial adjustment between said drive shaft support and said bearing frame.

9. The centrifugal pump of claim 8 wherein said second adjustment apparatus further comprises at least one adjusting screw positioned between said bearing frame and said plate-like member which provides selective axial adjustment between said bearing frame and said plate-like member.

10. The centrifugal pump of claim 1 further comprising a sealing mechanism having a defined seal height and being configured to be axially movable with said drive shaft to retain said seal height.

11. A centrifugal pump of the chopper type structured to provide axial adjustment of elements of the pump, comprising:

a pump casing for receiving at least a portion of a drive shaft therethrough;

an impeller attached to said drive shaft, said impeller having at least one vane having cutting edge;

a chopper plate having a cutting member for interacting with said cutting edge of said vane of said impeller;

first adjustment apparatus positioned between said pump casing and said drive shaft to effect axial adjustment of said impeller relative said chopper plate by axial movement of said impeller toward said chopper plate;

a plate-like member positioned between said pump casing and said impeller;

cutting elements positioned between said impeller and said plate-like member; and second adjustment apparatus positioned between said pump casing and said plate-like member relative to said impeller.

12. The centrifugal pump of claim 11 wherein said plate-like member is a back plate slidably movable relative to said pump casing.

13. The centrifugal pump of claim 12 wherein said back plate is further structured with a collar providing a housing for a seal assembly.

14. The centrifugal pump of claim 12 wherein said second adjustment apparatus further comprises at least one adjustment screw positioned between said pump casing and said back plate to effect axial movement of said back plate relative to said impeller.

15. The centrifugal pump of claim 11 further comprising a sealing mechanism positioned about said drive shaft, said sealing mechanism further comprising seal members with a defined seal height, and further wherein said sealing mechanism is configured to be axially movable with said drive shaft to retain said seal height of said seal members.

* * * * *